US005372156A

United States Patent [19]

Kern

[11] Patent Number: 5,372,156

[45] Date of Patent: Dec. 13, 1994

[54] BICYCLE SUPPORTED TENT

[75] Inventor: Wolfgang Kern, Triberg, Germany

[73] Assignee: Mehler Camping GmbH, Fulda, Germany

[21] Appl. No.: 118,994

[22] Filed: Sep. 9, 1993

[30] Foreign Application Priority Data

Sep. 10, 1992 [DE] Germany ..... 9212209[U]

[51] Int. Cl.[5] ..... B60P 3/32; E04H 15/02

[52] U.S. Cl. ..... 135/88.03; 135/87; 280/288.4; 296/136

[58] Field of Search ..... 135/880 R, 907, 116, 135/117, 87; 280/288.4; 296/77.1, 136

[56] References Cited

U.S. PATENT DOCUMENTS

| | | | |
|---|---|---|---|
| 527,549 | 10/1894 | Frankenberg | 135/88 |
| 3,913,968 | 10/1975 | Luppens | 135/88 |
| 4,114,633 | 10/1978 | Herbez | 135/88 |
| 4,930,557 | 6/1990 | Lohse | 135/88 |

FOREIGN PATENT DOCUMENTS

| | | | |
|---|---|---|---|
| 039969 | 10/1953 | France . | |
| 353244 | 12/1977 | France . | |
| 8265954 | 1/1952 | Germany | 135/88 |
| 228500A | 8/1990 | United Kingdom . | |

*Primary Examiner*—Carl D. Friedman
*Assistant Examiner*—Wynn E. Wood
*Attorney, Agent, or Firm*—Whitham, Curtis, Whitham & McGinn

[57] ABSTRACT

A tent, comprising an awning, is supported by a bicycle arranged in a principal plane to form at least one crest line. The bicycle is spanned on both sides of the principal plane by spanning means being anchored in the ground and being attached to said awning, particularly by means of cords and tent pegs.

6 Claims, 4 Drawing Sheets

BICYCLE SUPPORTED TENT

BACKGROUND OF THE INVENTION

1. Field of the Invention

The present invention generally relates to a tent and, more particularly to a new tent that is especially designed for the needs of a bicyclist or mountain biker.

2. Description of the Prior Art

Light weight tents designed for backpackers are well known in the art. In known tents, the supporting rods are often two vertically arranged poles, e.g. in form of aluminum tubes being composed of discrete tube segments. The assembled poles are spanned to the ground by means of cords and pegs driven into the soil. In some tents the two vertical poles are linked by a crest rod. In both cases during construction of the tent a compromise has to be found with respect to the rod assembly between the demand that the built-up tent should stand stable under all weather conditions, e.g. high wind speeds, and the demand that the tent should require only a small packing volume and be of low weight.

Known rod assemblies have been unsatisfying, particularly under the last mentioned points of view, since the wall thickness and dimensions required to create a stable tent lead to a high weight. During transportation of a packed tent on a bicycle it is furthermore disadvantageous that the pole segments that comprise the rod assembly cannot be made of a very short length, because the higher number of joints required within the rod assembly weakens the structure and the time needed to set up the tent rises in an unreasonable relation. Therefore, bulky and awkwardly shaped parts have to be attached to and carried on the bicycle.

Generally, it is the object of any tent designer to construct a particular stable structure at a weight as low as possible as well as to minimize the volume of the packed tent as much as possible. This holds true particularly in all those cases where the tent has to be carried under extreme conditions by human muscle forces, e.g. in mountain bike hiking. On a bicycle storing space is very limited and for obvious reasons a tent to be carried on a bicycle should be as light weighted as possible.

Known from British patent application GB 2 228 500 is a tent using the frame of a bicycle and an air pump carried on said bicycle as supporting means or as a substitute for an rod assembly. According to this state of the art the bicycle, which should be of the type having a common diamond frame comprising a horizontal crossbar, is to be arranged perpendicularly to the principal plane of the erected tent and the pump is used as an additional means to support the tent awning in the principal plane of the erected tent. A drawback of this tent is the fact that it is very low due to the crossbar of the bicycle being the highest point and due to the fact that a standard air pump designed to be carried on the frame of a bicycle is too short to be used in a satisfying manner as a tent pole. Beside the low height of the crest lines of such a tent it turned out to be disadvantageous that the bicycle used as a substitute for a rod assembly is spanned indirectly via said bicycle pump and therefore insufficiently at least towards one side, so that the resulting shelter structure is comparatively unstable, particularly at high wind speeds.

Another drawback of the described state of the art is that the bicycle is left uncovered and is therefore subject to corrosion, particularly when the weather is rainy.

SUMMARY OF THE INVENTION

It is therefore an object of the present invention to improve a known tent and to provide a new tent that is especially designed for the needs of a bicyclist or mountain biker by providing a small packing, light weight tent which does not require bulky, heavy rods or poles.

It is a further object of the invention to provide a tent offering a high crest line without the use of an additional rod assembly, so that an average person can move inside the tent relatively unhampered.

Furthermore, the tent to be created shall be useable with any frame of a bicycle, particularly with a relatively new type of bicycle, the so called "mountain-bike".

The inventive tent is characterized in that a bicycle is used as a rod assembly in such a manner that the tent awning is supported by the saddle and at least two points of the handlebar, thereby forming two crest lines.

Preferably, the awning is cut and spanned in such a way that two crest lines are formed starting from the seat engaging surface on the saddle and extending in a V-like shape to the to seat bearing points on the handlebar of the bicycle, whereby the awning engages the handlebar preferably completely and is spanned across the front wheel of the bicycle thereby forming an apse. In that manner, a very stable structure is provided which can be erected by the bicyclist within a few minutes without the need to carry awkward shaped, bulky rods or the like.

In a preferred embodiment of the invention, the tent comprises furthermore a ground sheet, the ground sheet being connected with the awning, preferably by being sewed to the edges of the awning facing the ground or in a different manner. That way a tent is provided that not only provides shelter against rain and wind, but also protects against ground humidity.

The single piece embodiment of the awning, essentially forming the roof part, and the ground sheet provides furthermore the possibility to attach spanning loops to the seam extending on ground level when the tent is in its erected state. The spanning loops allow to better pass the span forces into the fabric of the tent thereby making a stable spanning of the tent easier. Furthermore, loops or sewed on handling straps can be provided at the points where the awning touches the handlebar, thereby allowing the awning to be aligned more easily during set up of the tent.

The invention furthermore relates to a particular suitable awning for erecting a tent in the described manner, using a bicycle as a supporting means.

According to the invention, with respect to the cut and lay out of the seams, such an awning is designed in such a manner that a three dimensional cover is formed, this cover being sized to fit over a common bicycle and defining a trapezoidal area on the awning by seams, the bottom edge of which facing the ground being between 52 and 72 inches long, while the upper edge having essentially the width of a common bicycle handlebar, i.e. being between 20 and 28 inches long. This trapezoidal area, forming in an erected state of the tent an apse being spanned over the front wheel of the bicycle, comprises an entrance slit, the slit being preferably closeable by means of zip or a Velcro TM band.

According to the invention, preferably the area defined by the two crest lines extending from the saddle to the engagement points on the handlebar is reinforced by a second layer of fabric, or is defined by seams coinciding with the crest lines. The reinforced area or area defined by seams, respectively, has the form of a isosceles triangle, whereby the seam extending in the erected state over the handlebar has a length between 20 inches and 28 inches and at the ends—already mentioned—loops or handling straps consisting of a plastic band can be attached. The height of the isosceles triangle, in which also a seam can be arranged, is preferably between 22 and 52 inches.

Advantageously, the tent awning is furthermore linked to a ground sheet along the edge facing the ground in an erected state of the of the tent. Referring to this embodiment, the expression awning can designate the whole resulting, sack like arrangement. To erect the tent, the bicycle is stuffed rear wheel first into the sack-like awning through said entrance slit being provided in said trapezoidal area, and then the bicycle is spanned and secured by means of cords attached to the various spanning loops and tent pegs being secured to the ground.

Another asset of the tent according to the invention is that the bicycle not only has a function as rod arrangement but at the same time also is protected against theft.

Preferably the tent or the awning is made of a silicon coated polyester fabric. Using such a fabric results in a total weight of the awning plus the ground sheet of less than 1 kg (2.2 pds) provided the bicycle has normal dimensions.

The inventive tent preferably comes with a special designed packing sack, having three Velcro TM buckles, by means of which the folded awning can be attached to the rear triangle of the frame of a mountain bike. The packing sack comprises preferably a cylindric form, whereby to Velcro TM buckles are provided in a seam coinciding with a surface line of the cylinder and are provided to encompass the crossbar of the frame, while an additional Velcro TM buckle disposed on the ground surface of the packing sack is provided to encompass the saddlebar, thereby hindering the mounted packing sack to slide along the crossbar.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
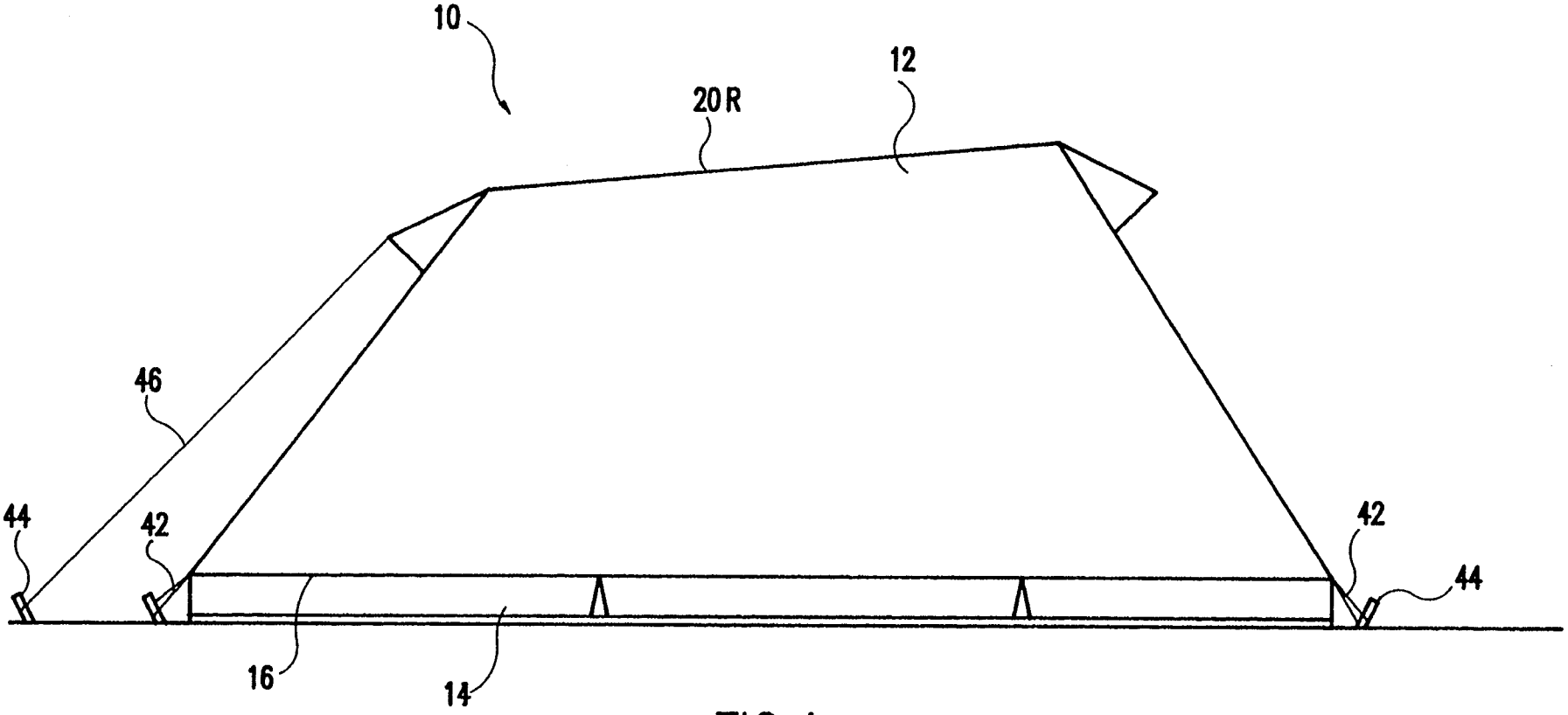
FIG. 1 is an elevation side view of a bicycle tent according to the invention.

Referring now to the drawings, and more particularly to FIG. 1, there is shown a bicycle tent 10 according to the invention which comprises an awning 12 which provides roof surfaces and is connected to a ground sheet along an edge 16 of the upper awning .facing the ground. The awning and the ground sheet are connected, e.g. by means of a seam which can be sealed in a waterproof manner by an additional adhesive strip or the like.

Figure 2:
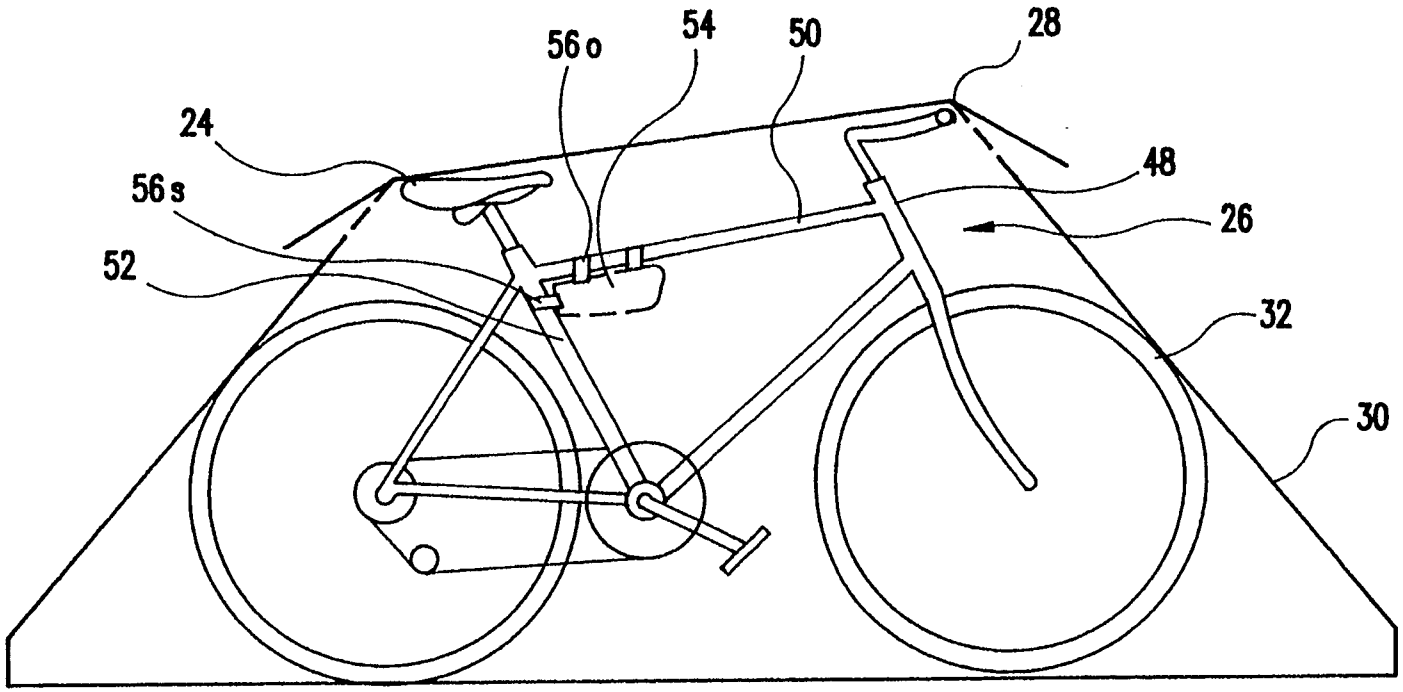
FIG. 2 is a cross section of a tent according to FIG. 1.
Figure 3:
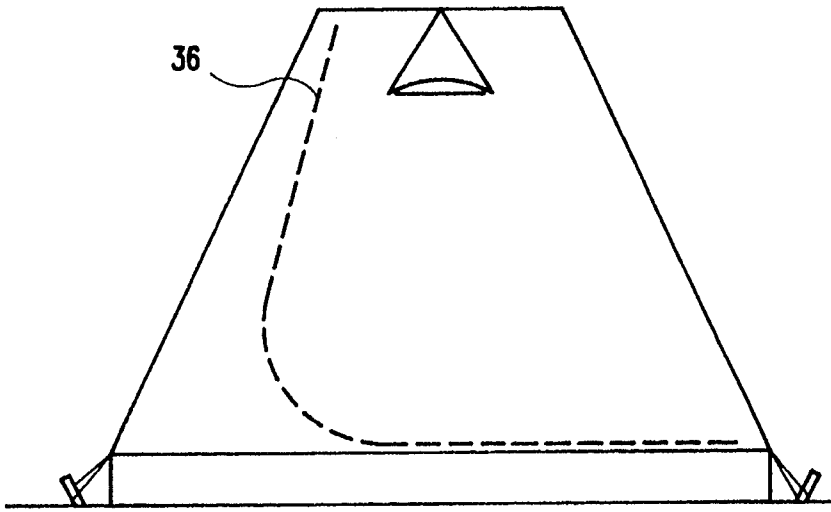
FIG. 3 is a front view of a tent according to FIG. 1.
Figure 5:
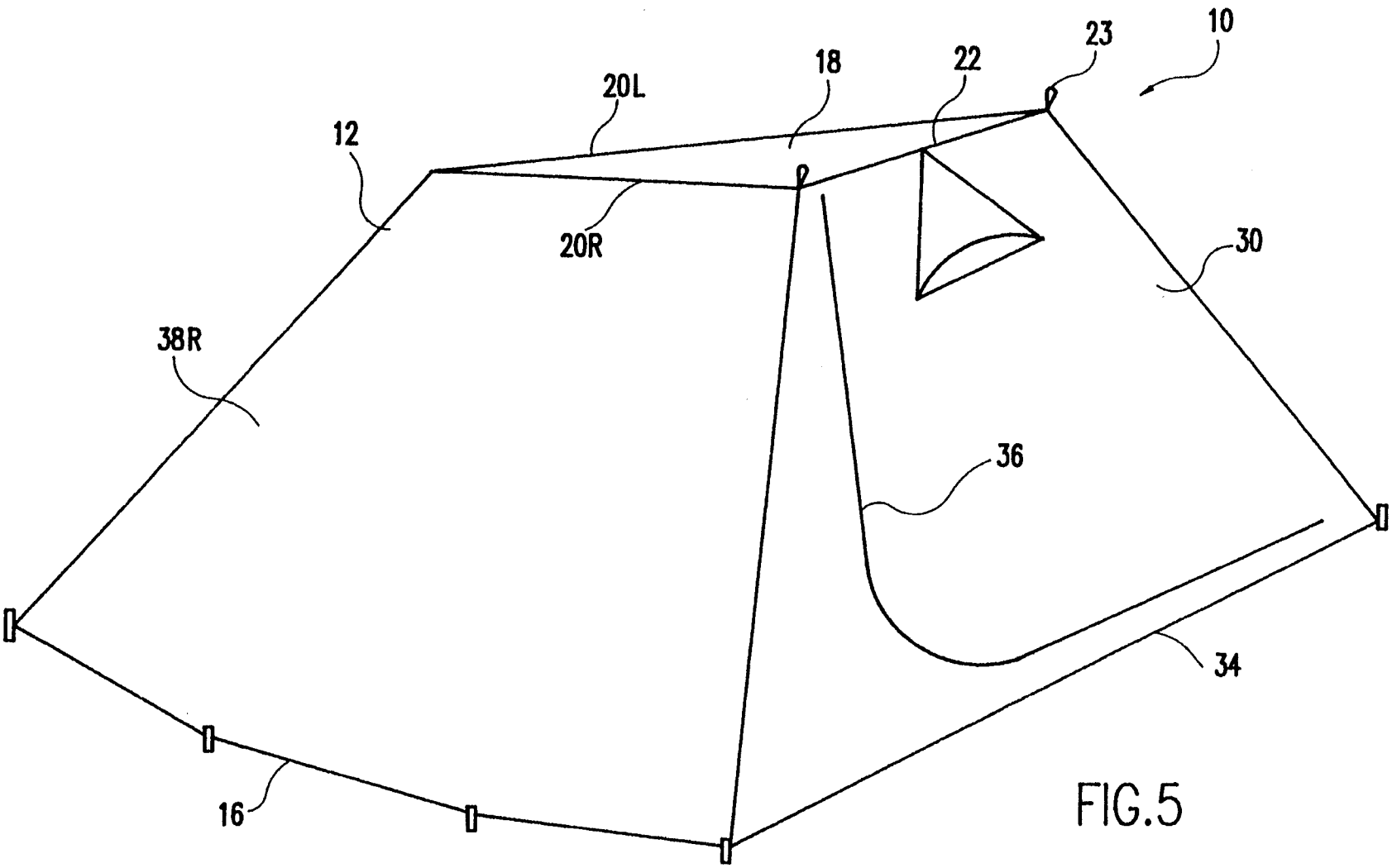
FIG. 5 is a perspective view of the erected bicycle tent according to the invention.

With reference now to both FIGS. 1 and 5, the upper awning 12 consists of different areas being defined by cut and seam arrangement. It is comprised of a triangle shaped area 18 bordered by three seams 20L, 20R and 22. The triangle area 18 essentially has the shape of an isosceles triangle. In the erected state of the tent, the two seams 20L and 20R form two crest lines, extending from an point at which the awning engages the saddle 24 of an mountain bike 26, as seen in FIG. 2, to the outermost ends of the handlebar 28 of the mountain bike 26. Seam 22 extends coincident with the handlebar 28 and forms at the same time the upper edge of a trapezoidal area 30, shown in FIGS. 3 and 5, forming an apse and being spanned over the front wheel 32 of the bicycle 32. A lower edge 34, the length of which is between 52 inches and 72 inches dependent on the embodiment of the sack formed of the upper awning and the ground sheet and furthermore depending on the height of the bicycle being used as a supporting rod arrangement, extends parallel to the upper edge 22. To the left and the right of the seam or edge 22 handling loops are arranged, by means of which the awning can be adjusted and aligned during set up procedure of the tent.

The trapezoidal area 30 furthermore features an entrance slit 36, which can be closed using a zipper or a Velcro TM type fastener.

Figure 4:
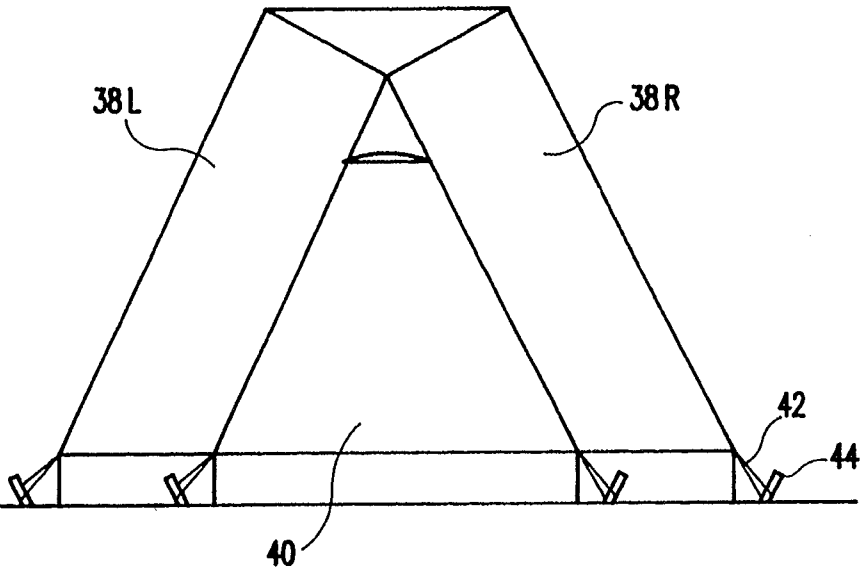
FIG. 4 is a rear view of a tent according to FIG. 1.

Referring now to FIG. 4, there are shown two triangle shaped roof areas 38L and 38R being joined with the triangle shaped, reinforced area 18 as well with the trapezoidal area 30 forming an apse. The two roof areas 38L and 38R are linked via a triangle shaped rear roof area 40, the top of which lies about in the bearing area of the upper awning on the saddle 24. Spanning loops 42 are arranged along the seam 16 connecting the ground sheet 14 to the awning 12, by means of which the awning an the vertically standing bicycle can be spanned to tent pegs driven into the ground. Preferably, the spanning loops have the form of elastic rubber rings. Additionally, cords can be attached to the awning, e.g. a cord 46 can be fixed at the seat engaging point of the upper awning 12 on the saddle 24, and being spanned to a tent peg 44 driven into the soil.

The bicycle visible in the cross sectional view of the tent in FIG. 2 comprises a frame 48 having a crossbar 50 and a saddle supporting bar 52. The packed tent can be attached to the triangle formed at the joint of crossbar 50 and saddlebar 52 by means of a specially designed pack sack 54. The pack sack 52 has an essentially cylinder shaped form comprising two Velcro TM fastening band loops $56_O$ being arranged in a surface line of the pack sack and encompassing the crossbar. An additional Velcro TM fastening loop $56_S$ encompasses the saddlebar of the frame, thereby preventing the pack sack from sliding along the crossbar.

The design of a bicycle tent provides a light weight tent that can be set up in very short a time, needing no additional rod arrangement or poles, yet providing a spacious shelter for two persons and a bike in all weather.

While the invention has been described in terms of a single preferred embodiment, those skilled in the art will recognize that the invention can be practiced with modification within the spirit and scope of the appended claims.

Having thus described my invention, what I claim as new and desire to secure by Letters Patent is as follows:

1. A collapsible tent for providing shelter which uses a bicycle as a support member, the bicycle comprising a seat and handlebars, the seat and handlebars providing support means for the collapsible tent, the tent comprising:

a flexible sack comprising a ground sheet and an awning sheet joined together at a peripheral edge, said awning sheet having a slit near said peripheral edge forming an opening for said sack, said flexible sack forming a tent when a bicycle is inserted through said opening of said sack and positioned over said ground sheet and under said awning sheet such that the bicycle acts as a central support for lifting said awning sheet away from said ground sheet to form a roof for said tent; and a plurality of spanning loops connected about said peripheral edge of said sack wherein said spanning loops anchor said ground sheet of said sack to the ground to form a floor for said tent.

2. A collapsible tent as recited in claim 1 wherein said roof comprises a triangle shaped top portion formed by said awning sheet contacting the bicycle at a left handlebar, at a right handlebar, and at a bicycle seat.

3. A collapsible tent as recited in claim 1 wherein said slit in said sack is closable by means of a zipper.

4. A collapsible tent as recited in claim 1 wherein said slit in said sack is closable by means of a fastener comprising a first flexible material having a plurality of hooks engaging to a second flexible material having a plurality of loops.

5. A collapsible tent as recited in claim 1 wherein said awning sheet is made from silicon coated polyester fabric.

6. A collapsible tent as recited in claim 1 wherein said ground sheet is made from silicon coated polyester fabric.

* * * * *